US010100794B2

(12) United States Patent
Barbier et al.

(10) Patent No.: US 10,100,794 B2
(45) Date of Patent: Oct. 16, 2018

(54) FUEL INJECTOR

(71) Applicant: DELPHI TECHNOLOGIES IP LIMITED, St. Michael (BB)

(72) Inventors: Philippe Barbier, Cellettes (FR); Thierry Cochet, Molineuf (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 94 days.

(21) Appl. No.: 15/325,857

(22) PCT Filed: Jun. 5, 2015

(86) PCT No.: PCT/EP2015/062570
§ 371 (c)(1),
(2) Date: Feb. 21, 2017

(87) PCT Pub. No.: WO2016/008640
PCT Pub. Date: Jan. 21, 2016

(65) Prior Publication Data

US 2017/0211533 A1 Jul. 27, 2017

(30) Foreign Application Priority Data

Jul. 15, 2014 (FR) ..... 14 56783

(51) Int. Cl.
*F02M 51/06* (2006.01)
*F02M 51/00* (2006.01)
(Continued)

(52) U.S. Cl.
CPC ..... *F02M 51/005* (2013.01); *F02M 61/168* (2013.01); *F02M 51/06* (2013.01);
(Continued)

(58) Field of Classification Search
CPC .... F02M 57/005; F02M 51/06; F02M 51/061; F02M 51/0614; F02M 51/0625;
(Continued)

(56) References Cited

U.S. PATENT DOCUMENTS

| | | | | |
|---|---|---|---|---|
| 5,372,313 | A | 12/1994 | Chabon et al. | |
| 5,381,965 | A | 1/1995 | Chabon et al. | |
| 9,567,957 | B2 * | 2/2017 | Schmieder | F02M 51/005 |
| 2002/0130206 | A1 | 9/2002 | Kobayashi et al. | |
| 2002/0138969 | A1 * | 10/2002 | Dallmeyer | F02M 51/005 29/602.1 |

(Continued)

FOREIGN PATENT DOCUMENTS

| | | | |
|---|---|---|---|
| DE | 102004015745 | A1 | 10/2005 |
| DE | 102005019806 | A1 | 11/2006 |

(Continued)

*Primary Examiner* — Christopher Kim
*Assistant Examiner* — Joseph A Greenlund
(74) *Attorney, Agent, or Firm* — Joshua M. Haines

(57) ABSTRACT

A fuel injector for an internal combustion engine includes an injector body in which there are positioned an actuator, a control valve, and a needle guide. The actuator actuates the control valve, the control valve controlling an injection needle sliding the needle guide between an open position in which injection is permitted and a closed position in which the injection of fuel is prevented. The injector additionally includes a first electrical connection extending from the needle guide to a metal that are internal to the injector, and a metal extension extending from the metal ring to a connector pin accessible from the outside of the injector, so that an electrical signal indicative of the position of the needle can be transmitted from the needle guide for the needle to the connector pin.

6 Claims, 3 Drawing Sheets

(51) Int. Cl.
*F02M 61/16* (2006.01)
*F02M 57/00* (2006.01)

(52) U.S. Cl.
CPC ..... *F02M 51/061* (2013.01); *F02M 51/0614* (2013.01); *F02M 57/005* (2013.01); *F02M 2200/245* (2013.01)

(58) Field of Classification Search
CPC ..... F02M 51/0628; F02M 51/0632; F02M 51/0664; F02M 51/0671; F02M 61/168; F02M 2200/241; F02M 2200/245
USPC ... 239/585.1, 585.2, 585.4, 585.5, 586, 584, 239/583, 96, 73, 74, 71; 123/406.47, 445
See application file for complete search history.

(56) References Cited

U.S. PATENT DOCUMENTS

| | | | | |
|---|---|---|---|---|
| 2010/0078507 | A1* | 4/2010 | Short | F02M 53/06 239/584 |
| 2014/0217204 | A1* | 8/2014 | Chandrashekar | F02M 51/005 239/585.5 |

FOREIGN PATENT DOCUMENTS

| | | | | |
|---|---|---|---|---|
| DE | 102005049259 | B3 | 1/2007 | |
| DE | 102011016168 | A1 | 10/2012 | |
| EP | 1036932 | A2 | 9/2000 | |
| EP | 2713040 | A1 * | 4/2014 | F02M 51/005 |
| WO | 2004097210 | A1 | 11/2004 | |
| WO | 2010/108766 | A2 | 9/2010 | |

* cited by examiner

FUEL INJECTOR

CROSS REFERENCE TO RELATED APPLICATIONS

This application is a national stage application under 35 USC 371 of PCT Application No. PCT/EP2015/062570 having an international filing date of Jun. 5, 2015, which is designated in the United States and which claimed the benefit of FR Patent Application No. 1456783 filed on Jul. 15, 2014 the entire disclosures of each are hereby incorporated by reference in their entirety.

TECHNICAL FIELD

The present invention relates to a fuel injector and more particularly to an arrangement allowing closed loop control of an injection system.

TECHNOLOGICAL BACKGROUND TO THE INVENTION

In today's common rail fuel injectors, the quantity of fuel injected and the opening and closing times of the injector are dependent on the ability of the industrial means of production to produce the injectors while respecting the key parameters of the injector. Variations occur as a result thereof. In addition, during operating cycles of the fuel injectors, certain parameters arise because of wear in the components. The rise and fall times of the control valve, as well as those of the needle of the injection nozzle, can be mentioned here as examples. Strategies are available for the supervision of the movements of the needle, in particular by measuring the variation in a current injected through the injector, the position of the needle causing said current to vary. This type of solution requires the provision in the injector of resistive coatings and of electrical connections allowing a known electrical path to be achieved by the injected current. The putting in place in the injector of electrical connections allowing the diagnosis of the position of the needle by the injection of a current is an industrial challenge. Problems of the reliability of the connections during the life cycle of the injector, as well as problems of productivity associated with the assembly time for such an injector, have impeded the putting in place of control strategies of this type in fuel injectors. It is therefore important to propose a novel solution resolving these problems.

SUMMARY OF THE INVENTION

A fuel injector for an internal combustion engine comprises: an injector body in which there are positioned an actuator, a control valve, and a needle guide. The actuator actuates the control valve, the control valve controlling an injection needle sliding in its guide between an open position in which injection is permitted and a closed position in which the injection of fuel is prevented.

The injector additionally comprises a first electrical connection extending from the guide for the needle to means of intermediate electrical connection that are internal to the injector, and also comprises a second electrical connection extending from said means of intermediate connection to a connector pin that is accessible from the outside of the injector, so that an electrical signal that is indicative of the position of the needle can be transmitted from the guide for the needle to the connector pin and is therefore accessible to an external electronic computer.

The means of internal intermediate connection may be constituted by a metal strip. The first electrical connection maybe in contact with the metal strip via a spring system positioned at the termination of the first electrical connection. The guide for the needle may include on its radial surface a hole receiving a termination of the first electrical connection, thereby enabling their electrical contact. The second electrical connection is integrated with the strip. The means of internal intermediate connection may include a metal ring positioned on the actuator.

According to another embodiment, an actuator may be provided for use in an injector, the actuator controlling a fuel injector control valve for an internal combustion engine. The actuator may include a metal ring positioned on its cylindrical periphery, said ring including a metal extension integrated with the ring extending longitudinally on the actuator.

A method of assembly of a fuel injector comprises the following stages: putting in place of a metal ring including a first metal extension substantially perpendicular to the ring and integrated with the ring by overmolding onto the cylindrical circumference of the actuator; positioning of the actuator in the housing of the body of the injector; connection of the first metal extension to a connector pin of the injector; insertion of a second metal extension into a housing of the valve body having a recess facing the ring, the termination of the second metal extension being provided with a spring system accommodated in the recess; assembly of the control valve with the actuator, the second metal extension passing through the body of the control valve; and assembly of the guide for the needle with the control valve, the second extremity of the second metal extension being provided with another spring system accommodated in a hole situated on the radial surface of the guide for the needle in contact with the control valve.

The stage of putting in place of the ring on the actuator may take place by insertion of the ring into a groove in the body of the actuator.

BRIEF DESCRIPTION OF THE FIGURES

Other characterizing features, aims and advantages of the invention will be appreciated from a perusal of the following detailed description, and having regard for the accompanying drawings, which are provided by way of non-exhaustive example, and in which.

DESCRIPTION OF PREFERRED MODES FOR IMPLEMENTING THE INVENTION

Figure 1:
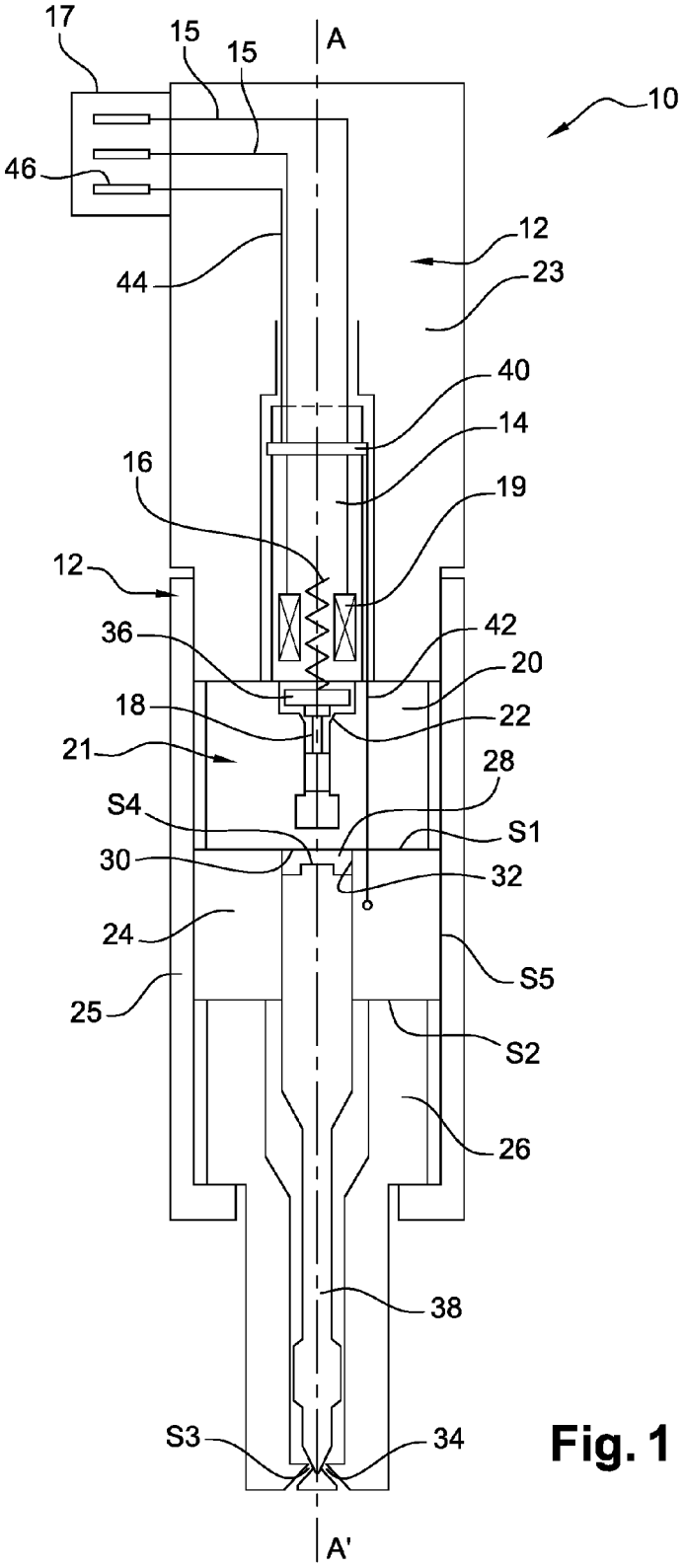
FIG. 1 is a representation of a fuel injector according to a first example of an embodiment of the present invention.

According to FIG. 1, a fuel injector 10 extending longitudinally along the axis A is an assembly of metallic components comprising fixed components and moving components.

The injector includes an injector body 12 in a number of parts, an upper part 23 and a lower part 25 or nut.

A substantially cylindrical solenoid actuator 14 is positioned in the upper part 23 of the body of the injector 12. A control valve 21 cooperating with the actuator 14 is positioned underneath the actuator 14 in the lower part 25 of the body of the injector 12, such that the upper radial surface of the control valve is in contact with the upper part 23 of the body of the injector 12. The actuator 14 is controlled by two control wires 15 connected to its coil 19 and joining a connector 17. The actuator 14 includes a return spring 16 positioned longitudinally along the axis A, said return spring acting upon the control valve 21.

The control valve 21 includes a valve body 20, in which there is positioned a fitting 36 that is integral with a stem 18. According to FIG. 1, and when the coil 19 of the actuator is not energized, the return spring 16 of the actuator 14 pushes back the fitting 36, the latter bringing the stem 18 of the control valve 21 into its seat 22, such that the control valve 21 is in its closed position. When the coil 19 of the actuator is energized, the fitting 18 is attracted magnetically towards the actuator 14 until it stops, causing the stem 18 of the control valve to accompany it from its seat 22 so as to open the control valve 21.

A guide 24 for an injection needle 38 is positioned in the lower part 25 of the body of the injector 12. The guide 24 for the needle has a radial surface in contact with the control valve 21 and a bore in which the injection needle 38 is positioned. The injection needle 38, of which the upper part is in connection with a control chamber 28, is capable of movement back and forth along the longitudinal axis A of the injector 10. The roof 30 of the control chamber 28 is in direct contact with the body 20 of the control valve 21, and the wall 32 of the control chamber is in contact with the body of the guide 24 for the needle 38.

A nozzle body 26 is positioned in the lower part 25 of the body of the injector 12. The injection needle 38 performs its back-and-forth movement in the middle part of the nozzle body 26 such that, when the injection needle 38 is in its seat 34, thereby preventing the injection of fuel, the injector is said to be in the closed position.

The essential fixed components of the injector 10 comprise the injector body 12, the actuator 14, the control valve body 20, the guide 24 for the injection needle, the injection nozzle 26, the control chamber 28 and the seat of the injection needle 34.

The moving components of the injector comprise, for example, the stem 18 of the control valve 21, the fitting 36 of the control valve 21 that is integral with the stem 18 of the control valve 21 and the injection needle 38.

The control wires 15 of the actuator make it possible to control the moving components of the injector 10.

The surfaces of the components of the injector that are in contact with one another are referred to as contact surfaces S.

In order to ensure the clear understanding of these different contacts, mention may be made, by way of example, of the contact surface S1 between the body 20 of the control valve 21 and the guide 24 for the needle, and also of the contact surface S2 between the guide 24 for the needle and the body of the injection nozzle 26. Mention may also be made, by way of example, of the contact surfaces S3 between the injection needle 38 and its seat 34, and also of the contact surfaces S4 between the injection needle 38 and the roof of the control chamber 30.

The injector additionally comprises a first electrical connection 42 extending from the guide 24 for the needle to a metal strip 40, and also a second electrical connection 44 extending from the metal strip 40 to a contact pin 46 of the connector 47, so that an electrical signal indicative of the position of the injection needle 38 may be accessible to an external electronic computer via this external means of connection.

A plurality of phases may be distinguished during operation of the injector 10.

In a first phase, during energization of the actuator 14 via the control wires 15, the fitting 36 is attracted against the actuator 14, causing the stem 18 of the control valve 21 to accompany it. The control valve 21, thus having been opened, brings about a drop in pressure inside the control chamber 28. This drop in pressure brings about the displacement of the injection needle 38 until it abuts against the roof 30 of the control chamber 28. The injection needle 38 is thus no longer in its seat 34. This phase is referred to as the fuel injection phase.

In a second phase, when the actuator 14 is no longer energized by its control wires 15, the fitting 36 is pushed back by the spring 16, thereby bringing the stem 18 of the control valve 21 into its seat 22. The control valve 21, thus having been closed, brings about an increase in pressure inside the control chamber 28. This increase in pressure causes the displacement of the injection needle 38 into abutment against its seat 34. The injector 10, thus having been closed, is said to be in the non-injection phase.

The contact between the injection needle 38 and its seat 34 is established during the non-injection phases. The injection needle 38 is in the closed position. The contact between the injection needle 38 and the roof of the control chamber 30 is established when the injection needle 38 is in the upper abutment position, that is to say in the ascending end position during the injection of fuel. The injection needle 38 is also in permanent contact with the guide 24 for the needle, in which it performs its back-and-forth movement. This movement entails neither the contact of the injection needle 38 with the roof of the control chamber 30 nor the contact of the injection needle 38 with its seat 34 being established during this travel.

In order to ensure the operation of the device allowing the electrical signal to represent the position of the injection needle 38, the contact surfaces S1 between the guide 24 for the injection needle and the body 20 of the control valve 21, as well as the contact surfaces S2 between the guide 24 for the needle and the body of the nozzle 26, as well as the contact surfaces S5 between the guide 24 for the needle and the body of the injector 12, are coated with an electrically insulating coating of the resin type. The contact surfaces S3, S4 between the moving elements of the injector 10, that is to say between the injection needle 38 and its seat 34, as well as between the injection needle 38 and the roof of the control chamber 30, are coated with a coating having a non-zero resistivity, thereby allowing the detection of a difference in voltage due to the circulation of a detectable electric current through the coating, said detection being performed by the external electronic computer. The external computer and the body of the injector 12 are connected to one another by an electrical ground.

In order to detect the position of the injection needle, an electric current is injected into the injector via the contact pin 46 of the connector, reaching the body of the guide 24 for the injector by adopting the electrical path composed of the second electrical connection 44 connected to the metal component 40, the metal strip 40 being connected to the first electrical connection 42.

When the needle 38 is in contact with its seat 34, the injector 10 being in the closed position, the electric current continues along its path from the guide 24 for the needle towards the needle 38, and then from the needle 38 towards the seat 34, the seat 34 being integral with the nozzle 26, the nozzle 26 being in contact with the body of the injector 12. The electronic computer then detects a first drop in voltage due to the resistivity of the path taken.

When the needle 38 is in contact with the roof of the control chamber 30, the electric current continues along its path from the guide 24 for the needle towards the needle 38, and then from the needle 38 towards the body 20 of the control valve 21, the control valve 21 being in contact with the roof of the control chamber 30, and the current then continues along its path as far as the body of the injector 12. The electronic computer then detects a second drop in voltage due to the resistivity of the second path taken.

When the needle 38 travels between the seat 34 and the roof of the control chamber 30, the injected current may not then circulate, the guide 24 for the needle being insulated electrically from all possible paths towards the body of the injector 12. No drop in voltage is detected in this case.

Figure 2:
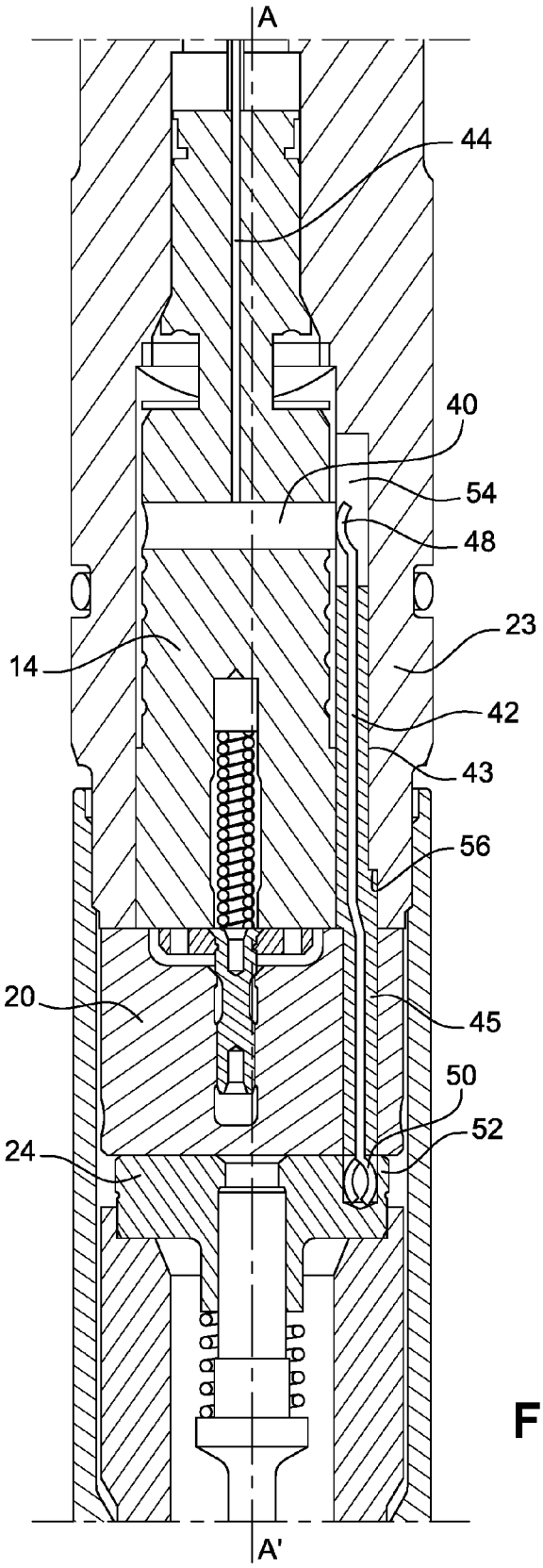
FIG. 2 is a partial representation of a fuel injector according to a second example of an embodiment of the present invention.

According to FIG. 2, the means 40 of internal intermediate connection to the injector 10 include a closed metal ring 40 positioned around the actuator 14 of the injector 10. The first electrical connection 42 is achieved by an overmolded wire 42, for which a termination is provided with a spring system 48 ensuring the electrical contact with the metal ring 40. The spring system 48 is of the curved spring strip 48 type. The spring system 48 is accommodated in a recess 54 in the body of the injector 12 positioned facing the metal ring 40, such that the curved spring strip 48 bears against the metal ring 40, thereby permitting an electrical contact to be established between the curved spring strip 48 and the ring 40. More specifically, the curved central part of the spring strip 48 bears against the metal ring 40.

The other termination of the overmolded wire 42 is provided with another spring system 50 capable of being accommodated in a hole 52 situated on the radial surface of the guide 24 for the needle 38, thereby ensuring their electrical contact. The other spring system 50 is of the torsion spring type, such that, once it has been positioned in the hole 52, the spring comes into contact with the lateral walls of the hole 52, in order thereby to ensure the electrical contact between the guide 24 for the needle and the overmolded wire 42.

The overmolded wire 42 extends longitudinally from the curved spring strip 48 positioned facing the metal ring 40 to the hole 52 situated on the radial surface of the guide 24 for the needle. In order to allow the passage of the overmolded wire 42, the upper part 23 of the body of the injector 12 includes a bore 43 from the recess 54 and opening onto another bore 45 formed to either side of the body 20 of the control valve 21 and opening onto the hole 52. The overmolded wire thus permits the indexing of the guide 24 for the needle with the control valve 21 and also of the control valve 21 with the body of the injector 12. A shoulder 56 on the internal face of the body of the injector 12, situated in proximity to the control valve 21, makes it possible to maintain the other spring system 50 that is provided with the overmolded wire 42 in the hole 52 of the guide for the needle. The second electrical connection 44 is integrated with the ring 40, the extremity of said second electrical connection 44 being connected electrically to the contact pin of the connector 46.

Figure 3:
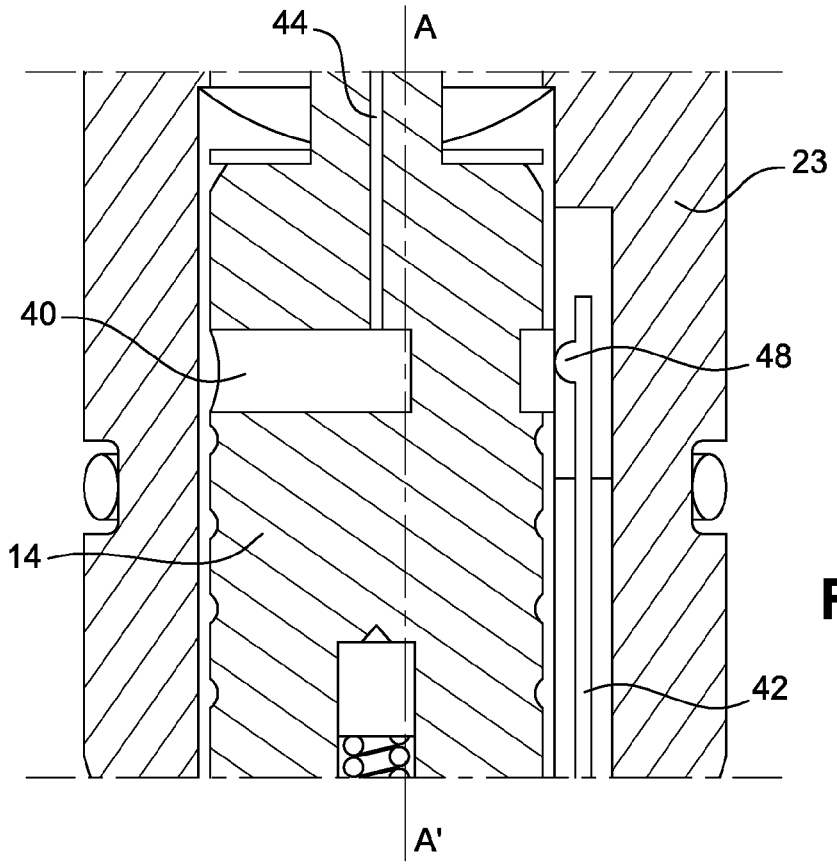
FIG. 3 is a partial representation of a fuel injector according to a second example of an embodiment of the present invention.

According to FIG. 3, the metal ring 40 is open. The second electrical connection 44 is a wire that is welded at its extremity to the ring 40. The ring has an angular sector in the order of 40 degrees. The second electrical connection 44 extending longitudinally A on the actuator 14. The metal ring 40 is secured advantageously to the cylindrical periphery of the body of the actuator 14. The metal ring 40 is inserted into a groove in the body of the actuator 14. The ring 40 is split and is elastic. The termination 48 of the overmolded wire 42 in contact with the metal ring 40 is of the spring-loaded pin 48 type.

Alternatively, the opening in the ring 40 may have a number of different values for the angular sector, said value being dependent on the means of attachment of the ring to the component of the injector 10 to which it is secured. By way of non-exhaustive example, the ring may have an angular sector in the order of 200 degrees, allowing it to be easily overmolded into the body of the actuator 14, thereby allowing contact to be avoided between said ring 40 and the body of the injector 12. In other embodiments, the ring 40 may have a width of at least 3 mm, in which case its angular sector may be comprised between 40 degrees and 360 degrees. Alternatively, the ring 40 may simply surround the body of the actuator 14 completely and in a circular manner.

Alternatively, the termination 48 of the overmolded wire 42 in contact with the metal ring 40 may have all kinds of protuberances permitting said contact with the ring 40.

The actuator may be of different type, such as, for example, and non-exhaustively, of the solenoid actuator type or alternatively of the piezoelectrical actuator type.

Alternatively, the first electrical connection 42 and the second electrical connection 44 may each be of different types such as, for example, conducting wires, rigid strips or any other electrical conductor allowing an electrical signal from the guide 24 for the injection needle to be conducted to the contact pin of the connector 46.

Additionally, alternatively and in a non-exhaustive manner, the two terminations 48, 50 of the first electrical connection 42 may, independently of one another, each be of the spring-loaded pin type, or of the curved spring strip type, or of the torsion spring type.

Figure 4:
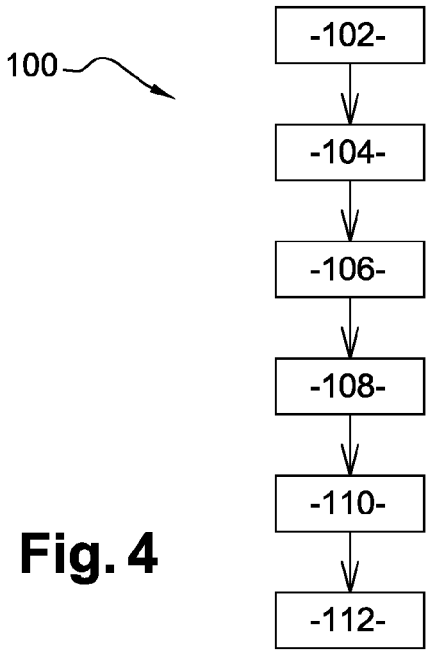
FIG. 4 is a representation of a method of assembly of a fuel injector of the present invention.

According to FIG. 4, a method of assembly 100 of a fuel injector 10 as described above may comprise the following stages:

putting in place 102 of the metal ring 40 including the first metal extension 44 substantially perpendicular to the ring 40 and integrated with the ring 40 by overmolding onto the cylindrical circumference of the actuator 14.

positioning 104 of the actuator 14 in the housing of the body of the injector 12.

connection 106 of the first metal extension 44 to the contact pin of the connector 46 of the injector 10.

insertion 108 of the second metal extension 42 into the housing of the valve body 12 having a recess 54 facing the ring 40, the termination of the second metal extension 42 being provided with the spring system 48 accommodated in the recess 54.

assembly 110 of the control valve 21 with the actuator 14, the second metal extension 42 passing through the body 20 of the control valve 21.

assembly of the guide 112 for the needle 24 with the control valve 21, the second extremity of the second metal extension 42 being provided with the other spring system 50 accommodated in the hole 52 situated on the radial surface of the guide 24 for the needle in contact with the control valve 21.

Alternatively, the stage of putting in place 102 of the ring 40 on the actuator 14 takes place by insertion of the ring 40 into a groove in the body of the actuator 14.

The invention claimed is:

1. A fuel injector for an internal combustion engine comprising, the fuel injector comprising:

an injector body in which there are positioned an actuator, a control valve, a needle guide; the actuator actuating the control valve, the control valve controlling an injection needle sliding in the needle guide between an open position in which injection is permitted and a closed position in which the injection of fuel is prevented;

a metal ring including a first metal extension substantially perpendicular to the metal ring and integrated with the metal ring, said metal ring and the first metal extension being over molded onto a cylindrical circumference of the actuator, the first metal extension being connected to a connector pin of the fuel injector; and a second metal extension inserted into a housing of the injector body having a recess facing the metal ring, wherein a first termination of the second metal extension being provided with a spring system accommodated in the recess so as to ensure electrical contact with the metal ring.

2. The fuel injector as claimed in claim 1, according to which the second metal extension is positioned through a body of the control valve.

3. The fuel injector as claimed in claim 2, according to which a second extremity of the second metal extension is provided with a second spring system accommodated in a hole situated on a radial surface of the needle guide for the injection needle in contact with the control valve so as to ensure electrical contact with the needle guide for the injection needle.

4. The fuel injector as claimed in claim 1, according to which a second extremity of the second metal extension is provided with a second spring system accommodated in a hole situated on a radial surface of the needle guide for the injection needle in contact with the control valve so as to ensure electrical contact with the needle guide for the injection needle.

5. A method of assembly of the fuel injector as described in claim 1, the method of assembly comprising the following stages:

putting in place of the metal ring including the first metal extension substantially perpendicular to the metal ring and integrated with the metal ring by overmolding onto the cylindrical circumference of the actuator;

positioning of the actuator in the housing of the injector body of the fuel injector;

connection of the first metal extension to the connector pin of the fuel injector;

insertion of the second metal extension into the housing of the injector body;

assembly of the control valve with the actuator, the second metal extension passing through a body of the control valve; and assembly of the needle guide for the needle with the control valve.

6. The method of assembly as claimed in claim 5, according to which the stage of putting the metal ring in place on the actuator takes place by insertion of the metal ring into a groove in a body of the actuator.

* * * * *